US005785540A

United States Patent [19]

Jaklin

[11] Patent Number: 5,785,540

[45] Date of Patent: Jul. 28, 1998

[54] ELECTRICAL CONNECTOR WITH AN ACTUATING SLIDE

[75] Inventor: Ralf Jaklin, Liederbach, Germany

[73] Assignee: The Whitaker Corporation, Wilmington, Del.

[21] Appl. No.: 726,730

[22] Filed: Oct. 7, 1996

[30] Foreign Application Priority Data

Nov. 10, 1995 [DE] Germany ..... 195 37 886.5

[51] Int. Cl.[6] ..... H01R 13/62

[52] U.S. Cl. ..... 439/157

[58] Field of Search ..... 439/152–60

[56] References Cited

U.S. PATENT DOCUMENTS

| | | | |
|---|---|---|---|
| 2,888,662 | 5/1959 | Hammell | 339/217 |
| 4,220,388 | 9/1980 | Dechelette | 339/74 R |
| 4,415,221 | 11/1983 | Inoue et al. | 339/258 F |
| 4,448,468 | 5/1984 | Coldren | 339/74 R |
| 4,534,613 | 8/1985 | Esser | 339/258 S |
| 4,579,409 | 4/1986 | Enneper et al. | 339/74 R |
| 4,679,887 | 7/1987 | Jackson | 439/849 |
| 5,322,460 | 6/1994 | Hass et al. | 439/849 |

FOREIGN PATENT DOCUMENTS

| | | | |
|---|---|---|---|
| 0 587 174 A2 | 3/1994 | European Pat. Off. | H01R 13/629 |
| 000603541 | 6/1994 | European Pat. Off. | 439/157 |
| 0 669 679 A2 | 8/1995 | European Pat. Off. | H01R 13/629 |
| 36 45 179 C2 | 9/1986 | Germany | H01R 13/629 |

*Primary Examiner*—Khiem Nguyen
*Assistant Examiner*—Eugene G. Byrd
*Attorney, Agent, or Firm*—Bradley N. Ditty

[57] ABSTRACT

The invention relates to an electrical connector which has a simple structure and can be joined together even blind with the complementary connector. The joining together can also be carried out with one hand. The electrical connector has an actuating slide in order to plug the connector pair one into the other, a lug on the second connector being moved through a slot on the actuating slide during the actuation of the actuating slide for the purpose of connecting and separating the connectors. Provided on the housing of the first connector is a latching arm having a latching hook, by means of which the second connector can be latched with the first connector in a prelatching position. The actuating slide is designed in such a way that this latching can be released by actuating the actuating slide.

7 Claims, 6 Drawing Sheets

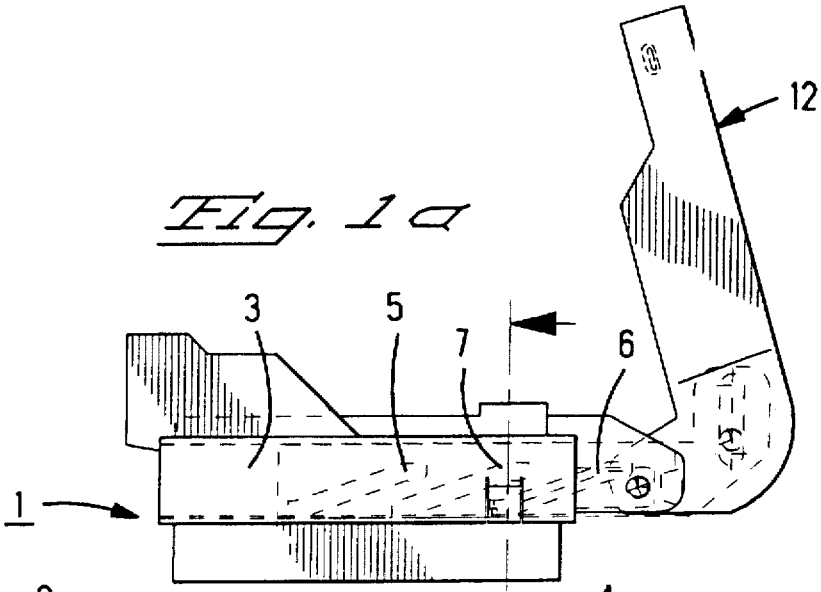
Fig. 1a
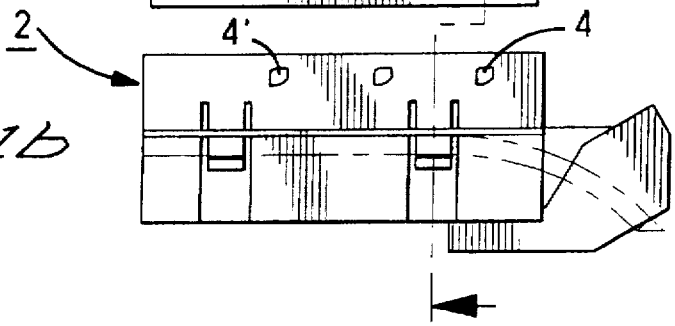
Fig. 1b
Fig. 3a
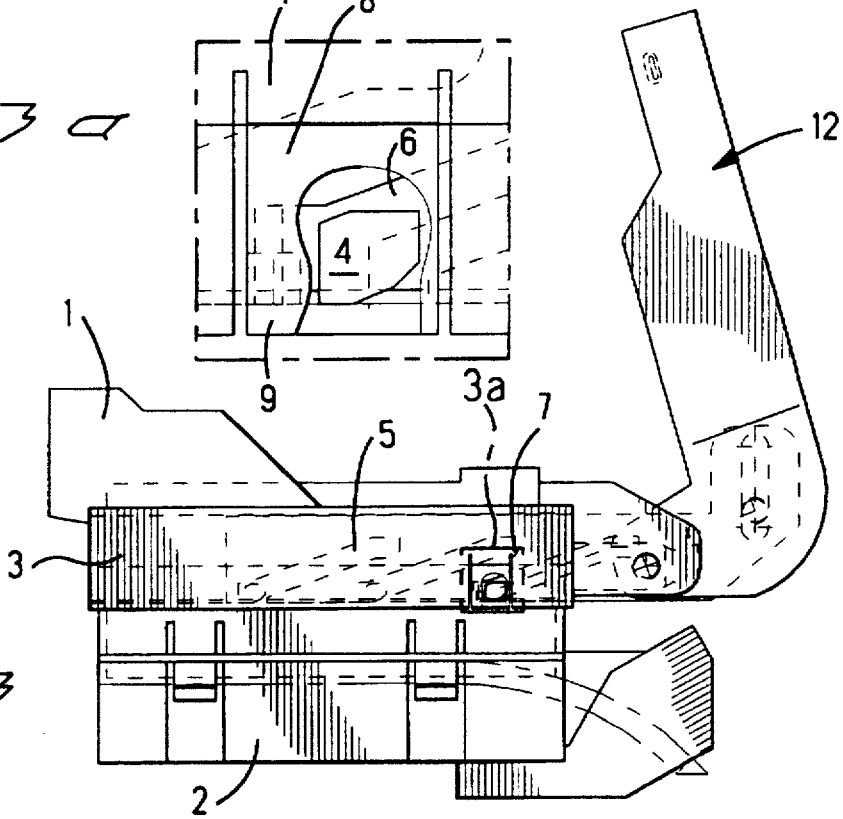
Fig. 3

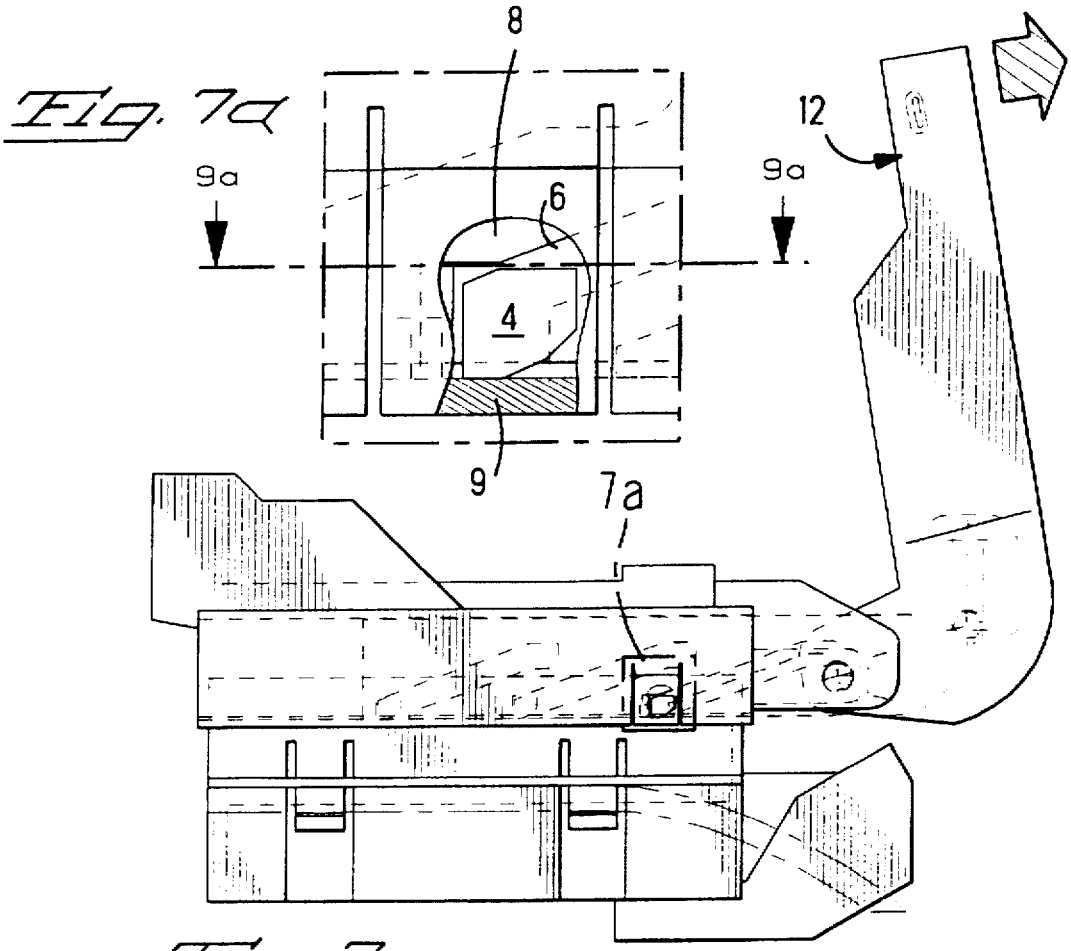
Fig. 7a
Fig. 7
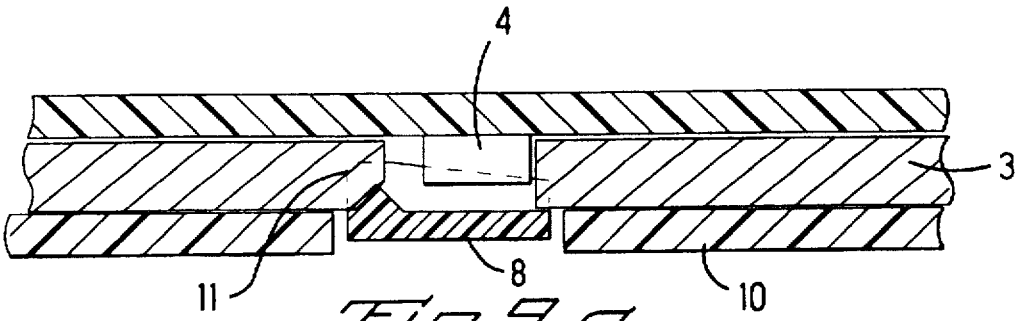
Fig. 9a
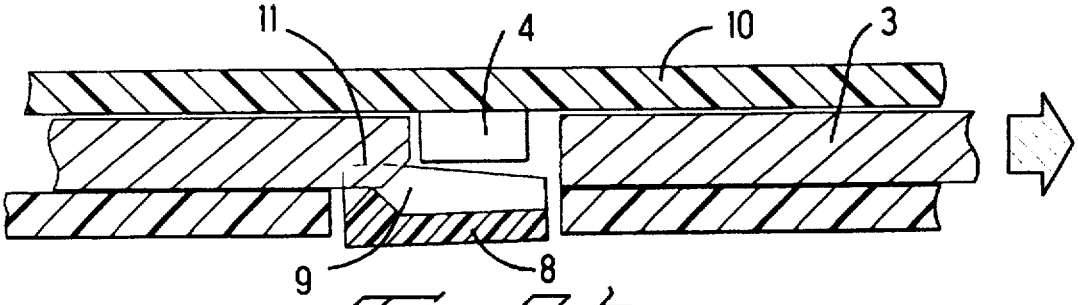
Fig. 9b

ELECTRICAL CONNECTOR WITH AN ACTUATING SLIDE

BACKGROUND OF THE INVENTION

1. Field of the Invention

The invention relates to an electrical connector having an actuating slide which can be connected to a second complementary connector.

2. Description of the Prior Art

Electrical connectors having a multiplicity of electrical contacts are connected to complementary connectors and then form a connector pair. The higher the number of contacts to be connected is, the greater is the force which is required to produce a connection between the connectors. It is known to use mechanical auxiliary means for connecting the two connectors of the connector pair to one another. These mechanical auxiliary means can be designed either as actuating slides or in the form of a lever. Actuating slides are normally moved in a transverse direction with respect to the insertion direction of the connectors. In this case, the actuating slide is integrated in one of the connectors and has either a guide groove or a guide slot or a lug, the connector to be connected then having the other part. If the two connectors are joined together, then the actuation of the actuating slide causes the lug to move through the guide groove or the guide slot. EP 587 174 A2 has disclosed an electrical connector arrangement, in particular for door connectors in automobiles. The connector arrangement has an insulating housing and an actuating slide which is of U-shaped design. Actuating the actuating slide brings the connector housing into the end position. The actuating slide in this case has two slots on each flank of the U. The lugs arranged on the connector housing move in these slots.

In many applications of connectors, it is important that the connectors can also be joined together when only one of the two connectors can be reached. Often this must also take place under more difficult circumstances, for example blind.

SUMMARY OF THE INVENTION

The object of the invention is to specify an electrical connector having an actuating slide which can be joined together in a particularly simple manner.

The object is achieved by means of an electrical connector having an actuating slide which can be connected to a second complementary connector, the actuating slide being inserted into the housing of the first connector and interacting with the second connector in order to plug the connector pair one into the other, a lug on the second connector being moved through a slot on the actuating slide during the actuation of the actuating slide for the purpose of connecting and separating the connectors, a latching arm having a latching hook is provided on the housing of the first connector, in such a way that the second connector latches with the first connector in a prelatching position before the connectors can be connected to one another using the actuating slide. Advantageous developments are specified in the subclaims.

It is particularly advantageous that the electrical connector specified can be joined together in a particularly simple manner. This joining together can be carried out not only blind but also with one hand. This is achieved by virtue of the fact that the two connectors are already connected to one another in a prelatching position, even when the actuating slide has not already been actuated for the purpose of connecting the connectors. As a result, it is possible already to secure the two connectors to one another even though they are not yet connected.

A further major advantage is that this latching in the prelatching position can also be released just with one hand, mainly by actuating the actuating slide. Since lugs are already provided for actuating the actuating slide it is a particularly simple solution to utilize these lugs also for the purpose of latching with the first connector in the prelatching position. Furthermore, it is particularly advantageous that the actuating slide has an entry position, in which the lugs can be inserted into the guide slots, and an end position in which the connectors are connected to one another. If the actuating slide is opened beyond the entry position when the connectors are separated, then the latching arms and the latching hooks are opened by the actuating slide in such a way that the lugs of the second connector are no longer secured in the first connector. Consequently, it is thus possible to separate the two connectors from one another even when actuating the actuating slide with one hand. Particularly simple actuation of the actuating slide is achieved by virtue of the fact that the first connector has a pivotable cover, with which the actuating slide can be actuated.

BRIEF DESCRIPTION OF THE DRAWINGS

FIG. 1*a* shows a side view of the first connector;

FIG. 1*b* shows a side view of the second connector;

FIG. 3 shows the two connectors 1 and 2 in the prelatching position;

FIG. 3*a* shows an enlargement of the detail indicated in FIG. 3;

FIG. 7 shows the two connectors in the prelatching position;

FIG. 7*a* shows a corresponding detail enlargement;

FIG. 9*a* shows a section corresponding to the lines AA as indicated in FIG. 7*a* in the latched position; and FIG. 9*b* shows the same section released from the prelatching position.

DETAILED DESCRIPTION OF THE PREFERRED EMBODIMENT

Figure 2A:
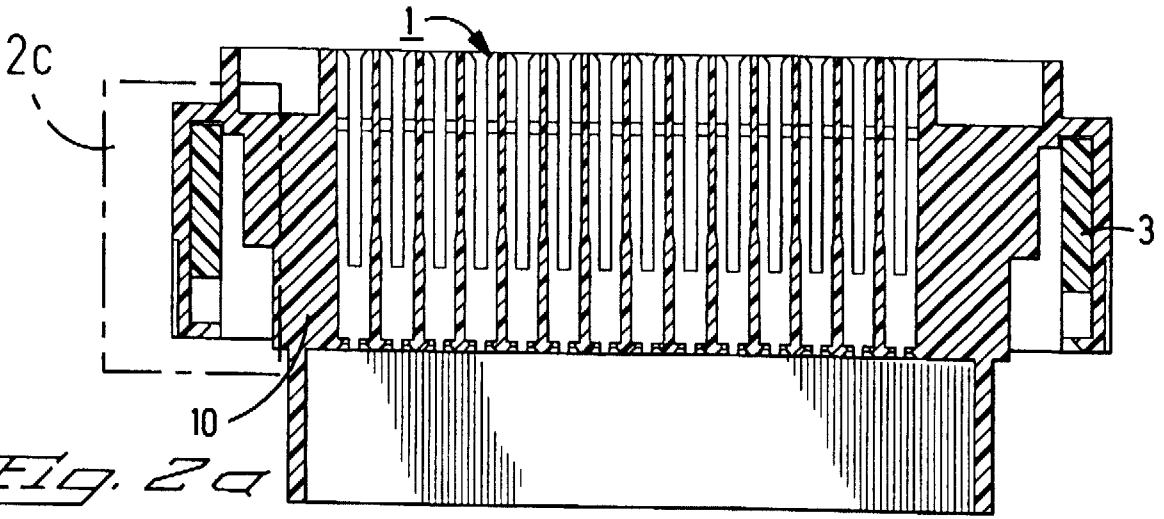
FIG. 2*a* shows a section through the first connector, through the sectional line indicated in FIG. 1*a;*
Figure 2B:
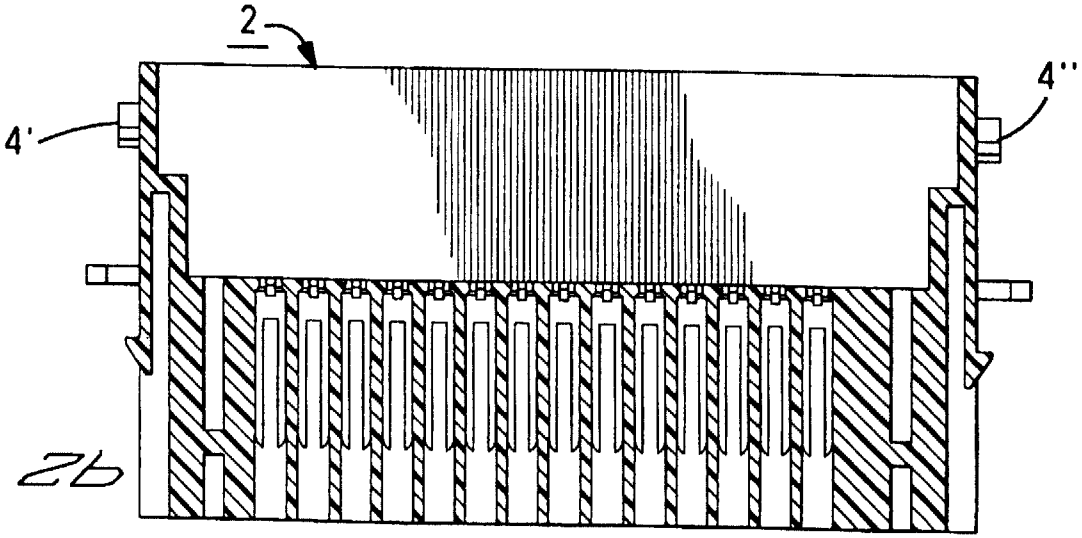
FIG. 2*b* shows a section through the second connector, through the sectional line indicated in FIG. 1*b;*

FIGS. 1*a* and 1*b* illustrate two complementary connectors, 1, 2. As can be discerned from FIGS. 2*a* and 2*b*, the complementary connectors 1, 2 have continuous chambers for receiving electrical contacts. The complementary connectors 1, 2 each have insulating housings 10. As illustrated in Figure 1*a*, the first connector 1 has an actuating slide 3. This actuating slide is moved perpendicularly to the insertion direction by means of a pivotable lever 12. The pivotable lever 12 simultaneously serves as a cover for the housing 10 of the electrical connector 1. The actuating slide 3 is of U-shaped design. On each side it has three guide slots, 5, 6 and 7 through which lugs 4, 4',4" on the complementary connector 2 are guided when the connectors are joined together. The lugs 4, 4', 4" can be seen in Figure 1*b* but also in FIG. 2*b*.

Figure 2C:
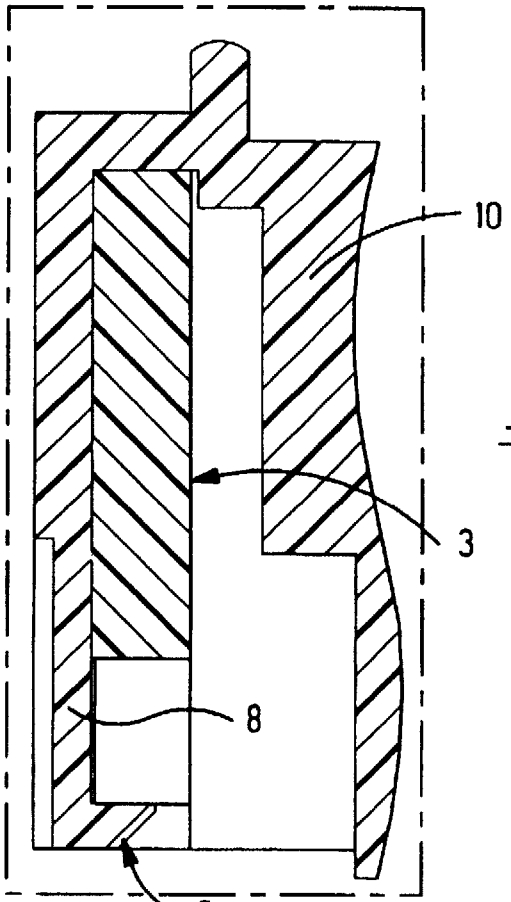
FIG. 2*c* shows an enlargement of the detail indicated in FIG. 2*a;*
Figure 4:
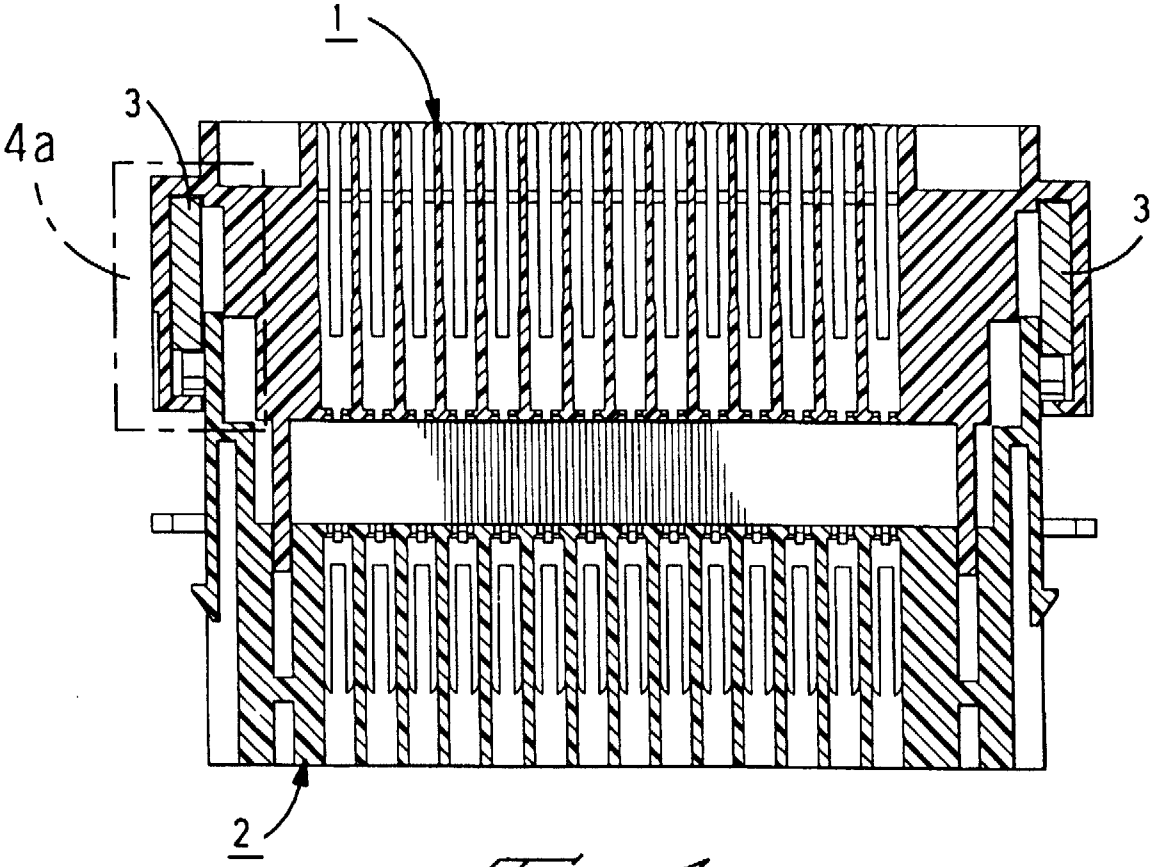
FIG. 4 shows a section through the illustration shown in FIG. 3.
Figure 4A:
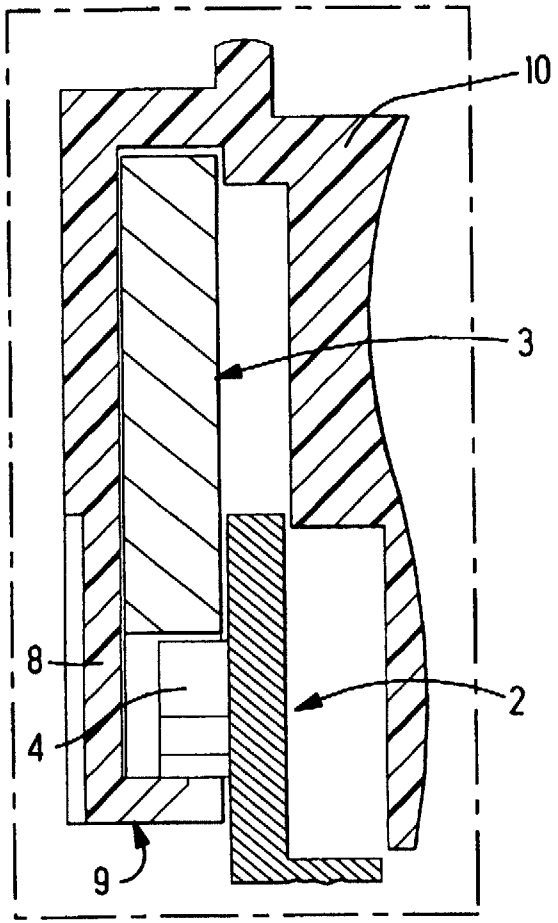
FIG. 4*a* shows a corresponding detail enlargement.

The detail enlargement illustrated in FIG. 2*c* shows the position of the actuating slide 3 in the housing 10. A resilient latching arm 8 having a latching lug 9 can clearly be seen. When the connectors are joined together, the lug 4 latches in a prelatching position behind the latching hook 9 on the latching arm 8. This can be discerned particularly clearly in FIG. 4*a*.

The two connectors 1 and 2 are now connected to one another in the prelatching position and the lugs are situated at the beginning of the guide slots in the actuating slide 3. This can be discerned particularly clearly in FIG. 3*a*. The lug 4, too, is already situated in the guide slot 6, the lug being latched behind the latching hook 9 of the latching arm 8. The actuating slide 3 has not yet been actuated for the purpose of joining together the connectors.

Figure 5:
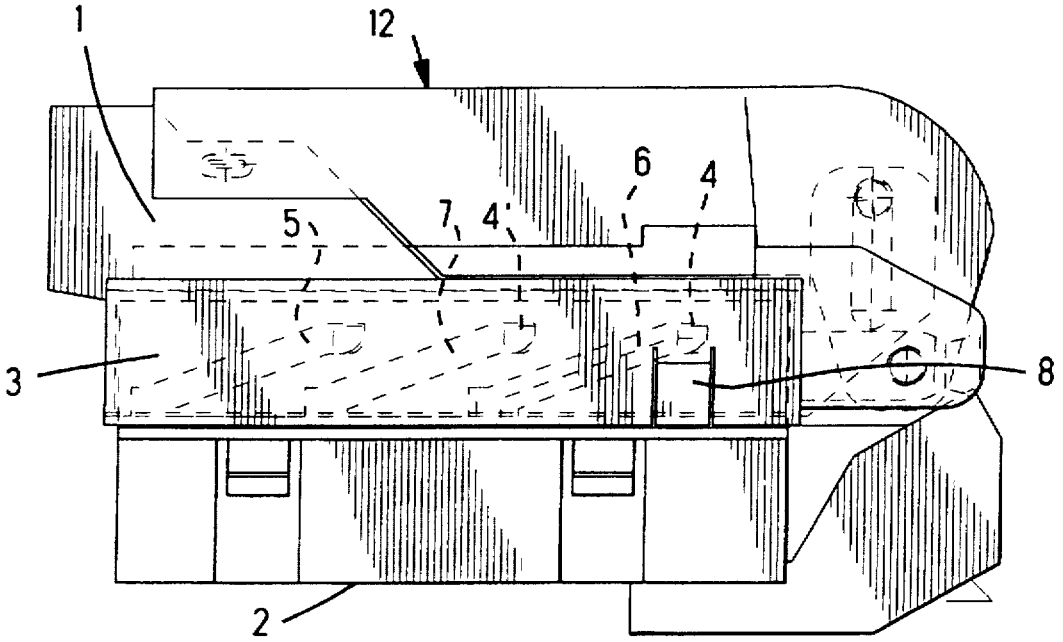
FIG. 5 shows the connectors 1 and 2 connected to one another.
Figure 6:
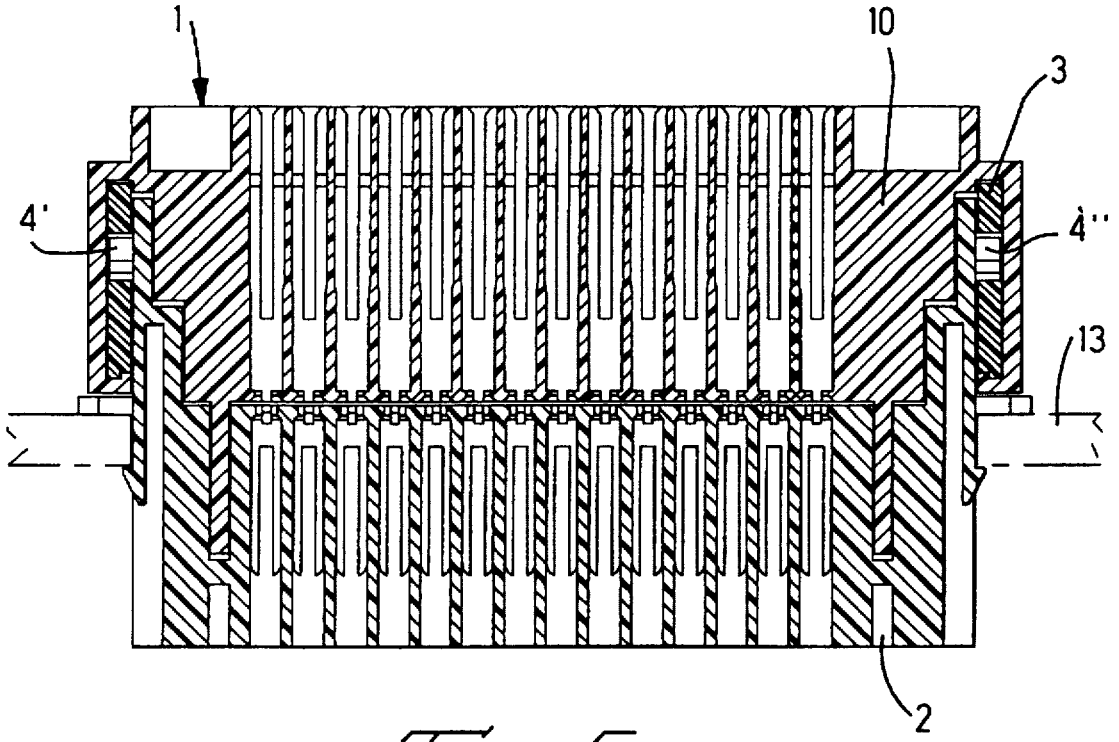
FIG. 6 shows a section through the above arrangement.
Figure 8:
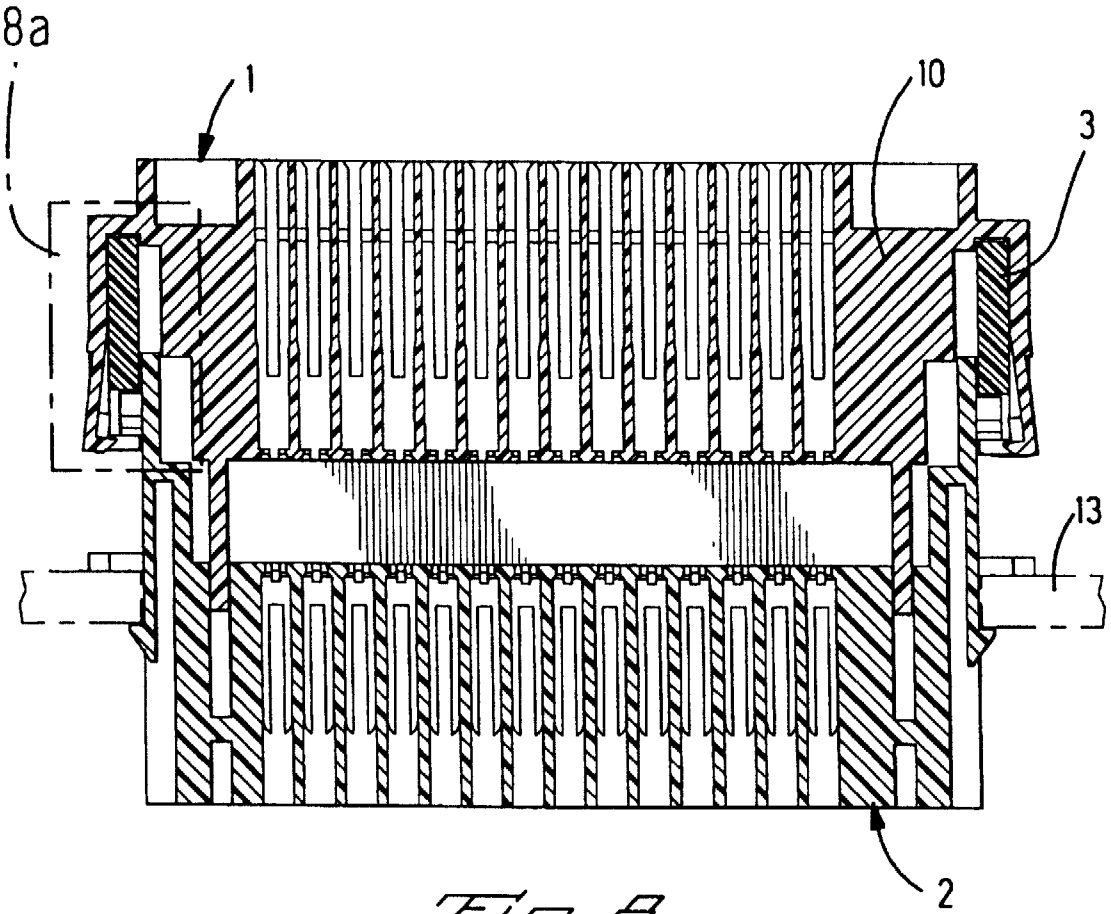
FIG. 8 shows a section through the two connectors in the prelatching position.
Figure 8A:
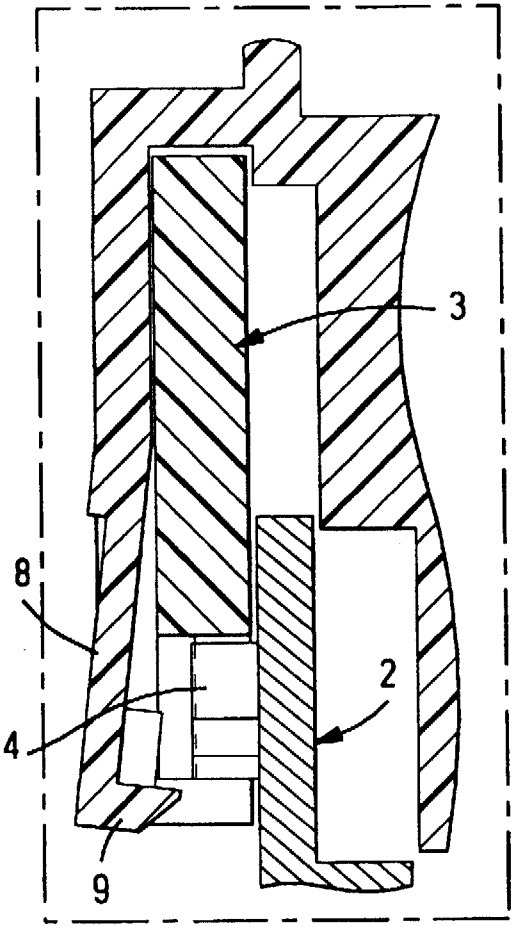
FIG. 8*a* shows a corresponding detail enlargement.

FIGS. 5 and 6 illustrate the actuating slide in its end position. The lugs 4, 4' and 4" are each situated at the end of the guide slots in the actuating slide 3. The actuating slide 3 is completely pushed in and the cover 12 correspondingly closed. If one would like to separate the connectors from one another again, then one actuates the pivotable cover 12 again, as a result of which the actuating slide 3 is moved. The movement of the actuating slide 3 causes the lugs 4, 4', 4" to move through the slots 5, 6, 7 until the lugs are situated at the beginning of the slots and the two connectors are again in the prelatching position.

It is now especially important that no additional tool and also no additional hand are needed to release the two connectors from the prelatching position. Actuating the cover 12 causes the actuating slide to move into an unlatching position in which a wedge 11, which is situated at the beginning of the guide slot 6, moves the latching arm 8 out of the latching position, as a result of which the lug 4 of the second connector can be removed from the latching device. By actuating the actuating slide into the unlatching position, it is possible to open the latching arm 8 with the latching hook 9. Consequently, it is thus possible, solely by pivoting the cover, or by actuating the actuating slide, for latching of the two connectors in a prelatching position and also unlatching as well as connection and separation of the connectors to take place. This is advantageous, for example, when one of the two connectors is fixed in a panel 13 and is not accessible.

What is achieved is that the two connectors can be plugged with just one hand, for example also blind.

I claim:

1. An electrical connector comprising a housing and an actuating slide which can be connected to a second complementary connector, the actuating slide being inserted into the housing of the electrical connector and interacting with the second connector in order to plug the connector pair one into the other, a lug on the second connector being moved through a slot on the actuating slide during the actuation of the actuating slide for the purpose of connecting and separating the connectors, a latching arm having a latching hook is provided on the housing of the electrical connector, in such a way that the second connector latches with the first connector in a prelatching position before the connectors can be connected to one another using the actuating slide, and that the latching of the electrical connector and the second connector in the prelatching position is released by actuating the actuating slide.

2. The electrical connector according to claim 1, wherein the latching arm has the latching hook latches that fit behind at least one of the lugs on the second connector.

3. The electrical connector according to claim 1, wherein the actuating slide has an entry position in which the lugs can be inserted into the slots, an end position in which the connectors are connected to one another, and has an unlatching position in which the latching arms having the latching hooks are opened in such a way that the lugs are no longer secured.

4. The electrical connector according to claim 1, wherein a wedge is arranged in an oblique plane at the beginning of a guide slot on the actuating slide, the wedge opens the latching arm when the actuating slide is actuated for the purpose of separating the connectors.

5. The electrical connector according to claim 3, characterized in that a wedge is arranged in an oblique plane at the beginning of a guide slot on the actuating slide, which wedge opens the latching arm when the actuating slide is actuated for the purpose of separating the connectors.

6. Electrical connector according to claim 1, characterized in that a pivotable cover is provided.

7. Electrical connector according to claim 6, characterized in that the actuating slide is coupled to the pivotable cover such that the actuating slide can be actuated using the pivotable cover.

* * * * *